US006259798B1

(12) United States Patent
Perkins et al.

(10) Patent No.: US 6,259,798 B1
(45) Date of Patent: Jul. 10, 2001

(54) PASSIVE RADIATOR COOLED ELECTRONICS/HEAT SINK HOUSING FOR A POWERED SPEAKER

(75) Inventors: Calvin C. Perkins, Portland, OR (US); Terry L. Wetherbee, Bothell, WA (US); David D. Bie, Indian Rocks Beach, FL (US)

(73) Assignee: Mackie Designs Inc., Woodinville, WA (US)

( * ) Notice: Subject to any disclaimer, the term of this patent is extended or adjusted under 35 U.S.C. 154(b) by 0 days.

(21) Appl. No.: 09/118,508

(22) Filed: Jul. 17, 1998

Related U.S. Application Data

(60) Provisional application No. 60/053,065, filed on Jul. 18, 1997.

(51) Int. Cl.[7] ..... H04R 25/00

(52) U.S. Cl. ..... 381/397; 181/199; 361/688

(58) Field of Search ..... 381/164, 397, 381/345, 332; 181/155, 156, 141, 148; 361/688, 697, 703, 704

(56) References Cited

U.S. PATENT DOCUMENTS

| | | | | |
|---|---|---|---|---|
| 3,778,551 | * | 12/1973 | Grodinsky | 381/397 |
| 4,210,778 | | 7/1980 | Sakurai et al. | 179/1 |
| 4,618,025 | | 10/1986 | Sherman | 181/148 |
| 4,811,403 | * | 3/1989 | Henricksen et al. | 381/397 |
| 5,216,210 | * | 6/1993 | Kammer | 181/148 |
| 5,533,132 | | 7/1996 | Button | 381/90 |
| 5,771,154 | | 6/1998 | Goodman et al. | 361/704 |
| 5,930,113 | * | 7/1999 | McCann | 381/704 |
| 6,038,129 | * | 3/2000 | Falaki et al. | 361/699 |
| 6,067,230 | * | 5/2000 | Ashida et al. | 361/704 |

* cited by examiner

*Primary Examiner*—Huyen Le
*Assistant Examiner*—P. Dabney
(74) *Attorney, Agent, or Firm*—Christensen O'Connor Johnson Kindness PLLC

(57) ABSTRACT

An electronics/heat sink housing used in combination with a loudspeaker or powered speaker having an enclosure, a passive radiator, and an electronics package. The electronics/heat sink housing includes a planar back plate, a top plate, two side plates, and a bottom connector plate. The housing is mounted directly onto a rear panel of the speaker enclosure over the electronics package and passive radiator of the speaker. A plurality of slots are formed within the electronics/heat sink housing, preferably along the side plates and top plate of the housing, where they are bent relative to the back plate. A plurality of larger slots also may be formed along the side plates of the housing. The total area of these slots is greater than the area of the passive radiator, so that the enclosure does not interfere with air movement and sound pressure wave propagation from the passive radiator. Air movement caused by the passive radiator serves to enhance the thermal cooling of the electronic components. Because of its efficient design, the overall depth of the speaker is minimized, enabling it to fit on a conventional bookshelf. The planar back plate may be positioned against a wall or other solid surface without a reduction in sound output.

22 Claims, 7 Drawing Sheets

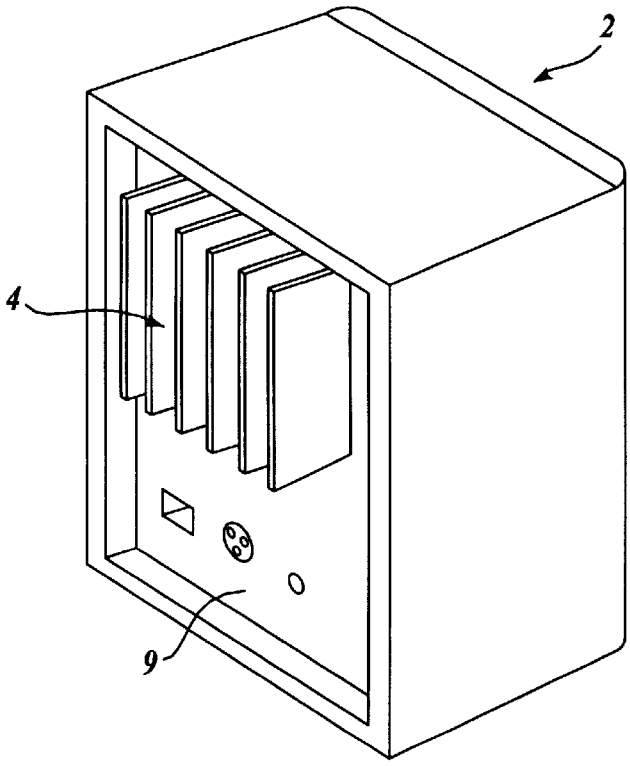
Fig.12.
(PRIOR ART)
Fig.13.
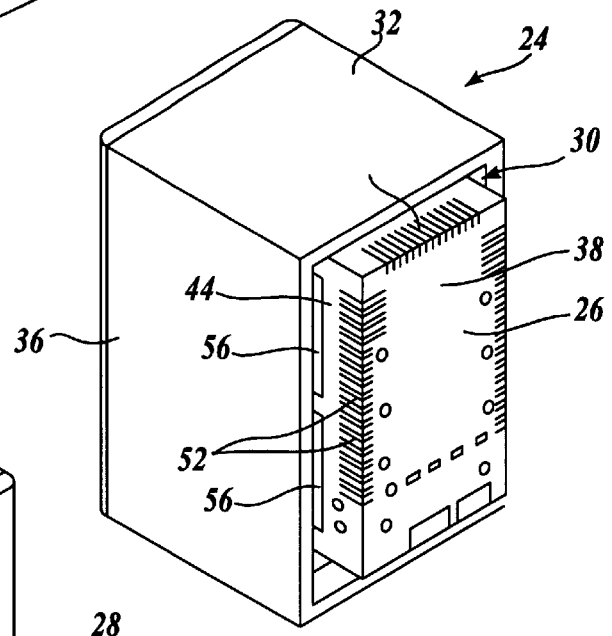
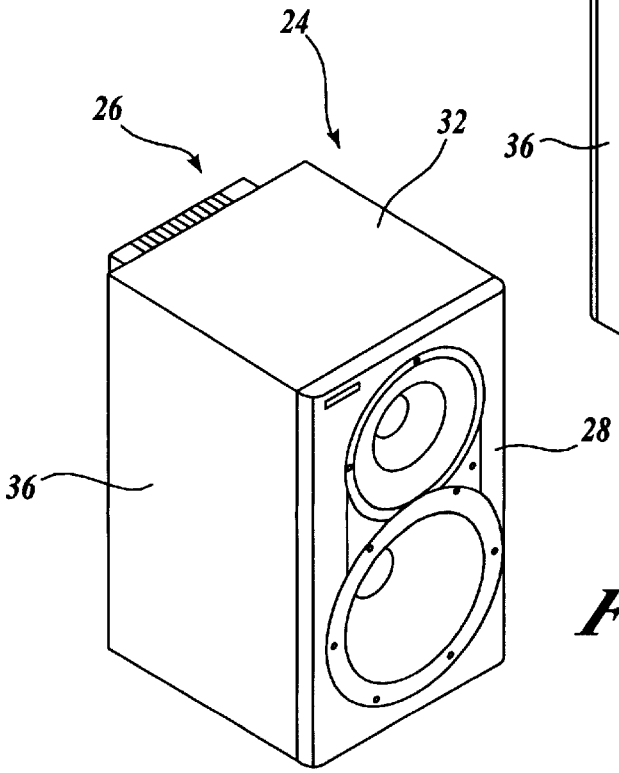
Fig.13A.

PASSIVE RADIATOR COOLED ELECTRONICS/HEAT SINK HOUSING FOR A POWERED SPEAKER

RELATED APPLICATION

This application claims priority to U.S. provisional application Ser. No. 60/053,065, filed Jul. 18, 1997, entitled "Passive Radiator Cooled Electronics Housing/Heat Exchanger for a Speaker" and is hereby incorporated by reference.

TECHNICAL FIELD

The present invention generally relates to a combined housing and heat sink for electronic components and, more specifically, to a housing and heat sink mounted over a port or vent of a speaker enclosure and cooled by moving air.

BACKGROUND OF THE INVENTION

The use of air moving over a loudspeaker driver to cool the speaker and a driver assembly is well known in the prior art. Such speaker driver cooling systems have been in use for a number of years. Typically, air moving through a vent or a port in the speaker enclosure passes over the speaker driver assembly, thereby providing cooling. Recently, a powered speaker has been introduced that uses a diecast aluminum front panel in which are exposed vents or ports. Air moving through the vents flows past a heat sink, such as internal webs or fins, that provides an increased surface area by which means heat produced from the speaker is absorbed and/or stored or removed. The air flow past the heat sink provides for more efficient cooling of the electronic amplifier and other components within the panel, as well as the speaker disposed inside the enclosure.

In most prior art powered speakers, the power amplifier module is convection cooled because forced air cooling creates air and mechanical bearing noise, which is objectionable in a speaker system. Aside from the recent prior art speaker noted above, use of relatively high velocity air moving through the vent or port of a speaker enclosure has only been used for cooling the speaker's electromagnetic driver—not the electronic components used in a powered speaker. Previous approaches used for cooling the electronic amplifiers and other circuit components in a loudspeaker have included either simple flat panels made of aluminum plate, finned aluminum extrusions (such as shown in FIG. 12), or elaborate die-castings. However, all of these approaches have relied on convection cooling. Each implementation used in the prior art has its own strengths and weaknesses. Any blockage of the cooling airflow will cause the electronic circuitry and speaker driver to either run at unacceptably hot temperatures, or activate a thermal limit switch, de-energizing the speaker.

A common challenge in designing small powered speaker systems of one cubic foot or less in volume is finding sufficient space and surface area for mounting the electronic circuits and their associated heat sink. To develop sufficient acoustic power at low frequencies in a small enclosure, use of power amplifiers capable of operating at up to 350 watts are not uncommon. Due to the requirement for high power at extended low frequencies, alternative methods for cooling the power amplifiers and electronics package must be developed that are cost effective and functionally efficient.

A typical prior art powered speaker enclosure 2 is illustrated in FIGS. 10 and 12. An extruded heat sink 4 (FIG. 12), input connector 6 (FIG. 10) and power connector 8 (also FIG. 10) extend outwardly from a rear panel of speaker enclosure 2 a distance $d_2$ (FIG. 10). As would be clearly noted in FIG. 10, the power and input connectors connect to a control panel 9 of FIG. 12, thus connectors 6 and 8 limit the proximity of speaker enclosure 2 to a wall or other surface behind the enclosure.

As shown in FIG. 10, the depth $d_1$ of the speaker enclosure 2, which is typically eight to twelve inches for a speaker ranging in size of six to ten inches in diameter, includes an additional depth $d_2$, which is the distance the connectors extend outwardly from the rear part of the speaker enclosure 2 approximately two to three inches. The overall enclosure depth $d_1$ plus $d_2$ will not always fit on a standard bookshelf. This is because the standard U.S. or European bookshelf is only eleven to twelve inches in depth. Although the overall depth of a speaker enclosure is not a performance issue, it is problematic to marketing considerations because a "bookshelf" speaker should be sized to actually fit on a standard bookshelf.

FIG. 4 shows another prior art enclosure 10 in which a vent 12 is disposed on the front panel of the enclosure, below a speaker 14. Sound waves emanate from speaker 14 and are designated as "17". Alternatively, vent 12' can be disposed on the rear panel 18 of enclosure 10, of which sound waves 17 will then radiate away from the rear of the enclosure, as shown in FIG. 5. A common problem with the configuration shown in FIG. 5 is that the rear facing vent 12' can be blocked when the rear panel 18 of enclosure 10 is placed against a wall 19 or other surface, such as shown in FIG. 6. In the graph of FIG. 7, a line 20 indicates the frequency response of a powered speaker having a vent that is not blocked in comparison to a line 22 that indicates the reduced low frequency response of the speaker when the vent is blocked.

In powered speakers, the space required for a heat sink 4 (FIG. 12) will conflict or interfere with that required for the electronic package having power amplifiers and/or other circuitry. If the electronic package is placed in or adjacent a rear facing vent to benefit from the air movement therethrough, and if the vent becomes blocked by placing a rear of the enclosure against a wall, overheating of the electronic circuitry will likely result, which can damage the speaker or, worse, cause an electrical fire.

Since it is desirable to maintain the smallest front panel surface area on a speaker enclosure for physical and acoustic reasons, while also providing the maximum amount of low frequency output, a passive radiator such as the kind disclosed in Applicants' co-pending U.S. patent application Ser. No. 09/115,507, filed Jul. 17, 1998, and entitled "Pistonic Motion, Large Excursion Passive Radiator" and which is incorporated by reference, is preferable to a vent, although more expensive. To achieve this small surface area on the front of the enclosure, the only surfaces available for mounting a passive radiator are the side panels, top panel, bottom panel and rear panel of the speaker enclosure. However, mounting the passive radiator on the side panels or top or bottom panels of the speaker enclosure is not practical because a user may lay the enclosure on its side or invert it, or suspend it from the ceiling so that the top is too close to the ceiling to permit the passive radiator to function properly. Thus, the only logical and practical place to locate the passive radiator is on the back of the enclosure. However, since the passive radiator discussed above occupies over 75% of the available surface area of the rear panel of the enclosure, there would not be sufficient room on the back of the enclosure to also include a solid extruded heat sink 4 like that used for the ported enclosure of FIG. 12.

Therefore, a novel approach is required that addresses each of the issues noted above. Specifically, the approach should enable a passive radiator and an appropriate cooling mechanism for an electronics package used in a powered speaker to be provided in a minimum amount of space and at a relatively low cost. The passive radiator and electronics package should both fit on the rear panel of a speaker enclosure and should not be subject to blockage when the enclosure is placed against a wall or other surface. The prior art does not provide a solution that meets these needs.

SUMMARY OF THE INVENTION

The present invention is directed to an electronics/heat sink housing for a powered speaker, as well as the combination of the powered speaker enclosure and electronics/heat sink housing. The housing is designed to act as a heat sink and heat exchanger to draw away heat from sensitive electronics. Such heat is generated by the powered speaker's electronic components and air movement and sound pressure waves generated by a passive radiator of the powered speaker, all of which are positioned within a predefined compact combined speaker enclosure. The combination of the speaker enclosure and electronics/heat sink housing is designed to fit upon a typical bookshelf without overhang and without sacrificing sound output.

In a first embodiment, an electronics/heat sink housing is used in combination with a powered speaker having a speaker enclosure including a rear panel, a front panel, a pair of side panels, and a pair of end panels. The powered speaker further includes a passive radiator, which is mounted to the rear panel of the speaker enclosure. The passive radiator propagates sound waves and air movement, while electronic components allow the speaker to audibly emit the sound pressure waves.

The electronics/heat sink housing includes a planar back plate, a pair of oppositely situated side plates, and a top plate, all of which form a substantially box-like cover of a size and shape to fit over the electronic components and passive radiator of the powered speaker. The housing is attached to a rear panel of the speaker enclosure over the electronic components and passive radiator. The housing defines a plurality of slots of a number such that the combined open air area of the slots is greater than the surface area of the passive radiator in order to allow heat and air flow created by movement of the passive radiator to exit the slots outside the housing.

According to another embodiment of the invention, the electronics/heat sink housing may further include a bottom plate, which is oppositely-positioned from that of the top plate. The bottom plate is connected to the back plate between the two side plates of the housing to perform an enclosed-like cover when mounted over the rear panel of the speaker enclosure. In a preferred form, the bottom plate is a connector panel that defines at least one opening of a size and shape to receive an input connector cable. Such an input connector cable extends parallel and in the longitudinal direction of the speaker enclosure. Thus, the input connector cable would not extend outwardly of the rear panel of the enclosure or the electronics/heat sink housing like that of the prior art. This valuable depth space is conserved with this embodiment In preferred form, the plurality of slots, or vents, are positioned between the side plates and the back plate, as well as the top plate and the back plate, where the side plates and top plates join the back plate.

In another embodiment of the present invention, a pair of flanges extend outwardly from the side plates such that one flange extends outwardly from a corresponding side plate. Each flange abuts and is fixedly attached to the rear panel of the speaker enclosure.

In yet another embodiment of the present invention, the electronics/heat sink housing may further include at least one slot positioned between the flange and its corresponding side plate. Here, the at least one slot between the flange's corresponding side plate is larger than the slots between the side plates and back plates, and the slots between the top plate and the back plate.

An additional heat sink may be added to the electronics/heat sink housing through a bracket mounted within the interior of the electronics/heat sink housing separating the electronic components from the heat sink housing. The bracket may be an "L-shaped" assembly, having a pair of oppositely situated "L-shaped" brackets interconnected and integral with a rigid central member. Alternatively, individual "L-shaped" brackets may be mounted on the interior of the electronics/heat sink housing and fixedly attached to the back plate. The bracket shape provides more area for heat from the electronic components to transfer to.

Preferably, the electronics/heat sink housing is at least 0.125 inches thick. Moreover, the housing is preferably fabricated from 1100 aluminum alloy sheet metal.

As the overall depth, as measured from the front panel of the speaker enclosure to the back plate of the electronics/heat sink housing, must fit on a typical bookshelf without overhang, the overall depth must not be greater than twelve inches.

The present invention also includes the combination of the powered speaker enclosure with the electronics/heat sink housing as already described above.

These and other features will be further discussed below.

BRIEF DESCRIPTION OF THE DRAWING

Like reference numbers are used to denote like parts throughout the various Figures of the drawing. The foregoing aspects and many of the attendant advantages of this invention will become more readily appreciated as the same becomes better understood by reference to the following detailed description, when taken in conjunction with the accompanying drawing, wherein:

FIG. 12 (PRIOR ART) is an isometric view of the rear of a powered speaker illustrating an extruded finned heat sink for cooling;

FIGS. 13A and 13 are respectively a perspective view of a speaker enclosure in which the preferred embodiment of the present invention is mounted on the rear panel, and a perspective view of the rear panel of the enclosure of FIG. 13A, with the housing and heat sink mounted thereon;

DESCRIPTION OF THE PREFERRED EMBODIMENT

The following description is provided to enable any person skilled in the art to make and use the invention and sets forth the best modes presently contemplated for carrying out this invention. However, various modifications to the disclosure will be readily apparent to those skilled in the art.

Figure 1:
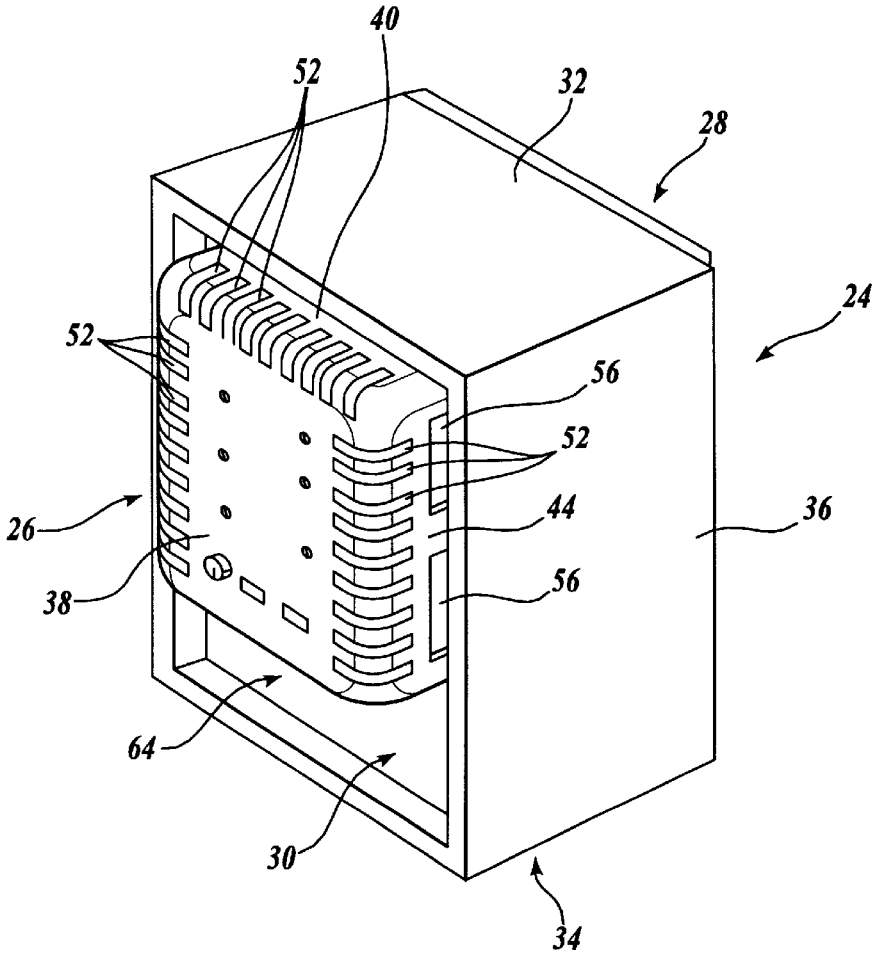
FIG. 1 is an isometric view of a speaker enclosure and an electronics/heat sink housing mounted to a rear panel of the speaker enclosure in accordance with a preferred embodiment of the present invention.
Figure 2:
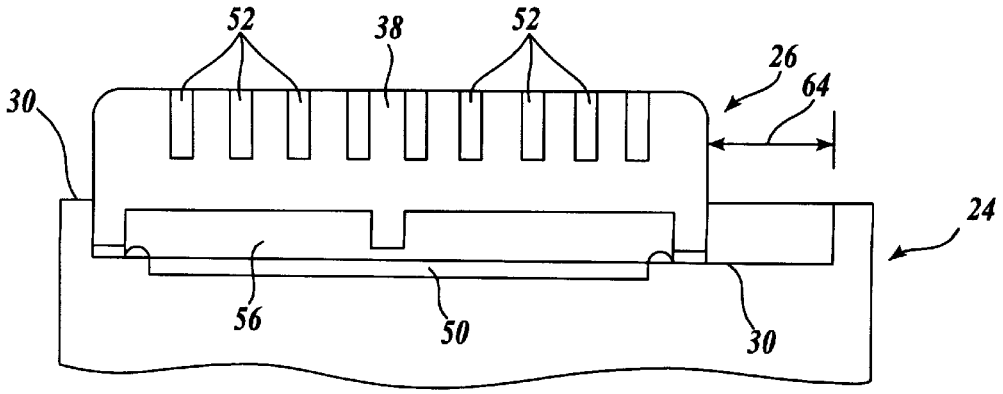
FIG. 2 is a side view of the speaker enclosure, with part of the speaker enclosure cut away to show the electronics/heat sink housing mounted over a passive radiator.

Referring to FIGS. 1, 13A and 13, the present invention is directed to a speaker enclosure 24 having an electronics/heat sink housing 26. The speaker enclosure is box shaped, having a front panel 28, a rear panel 30, a top panel 32, an oppositely-situated bottom panel 34, and two side panels 36.

Figure 14:
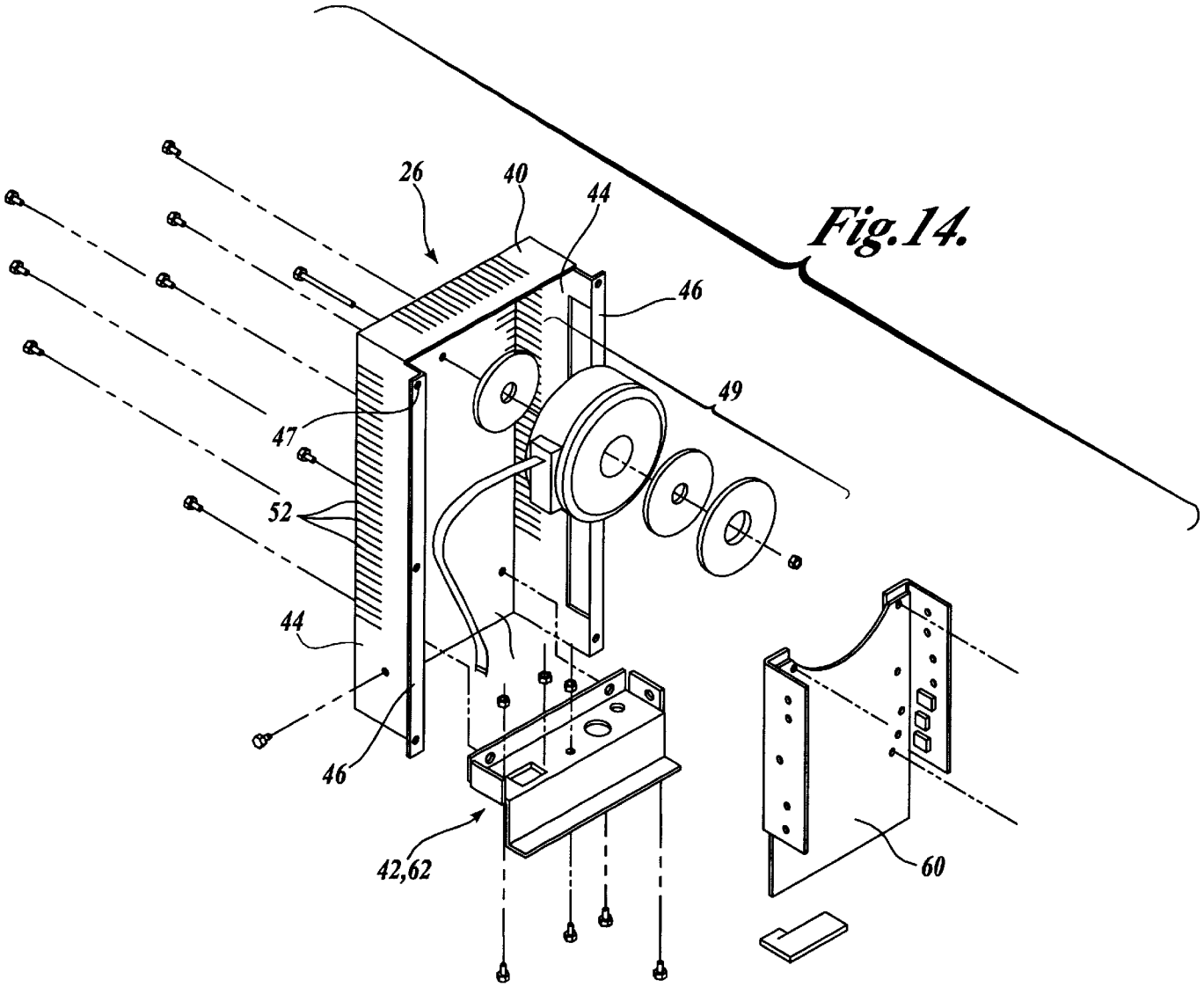
FIG. 14 is an exploded perspective view of the electronics/heat sink housing of the present invention shown with the typical electronics components and heat sink bracket.
Figure 15:
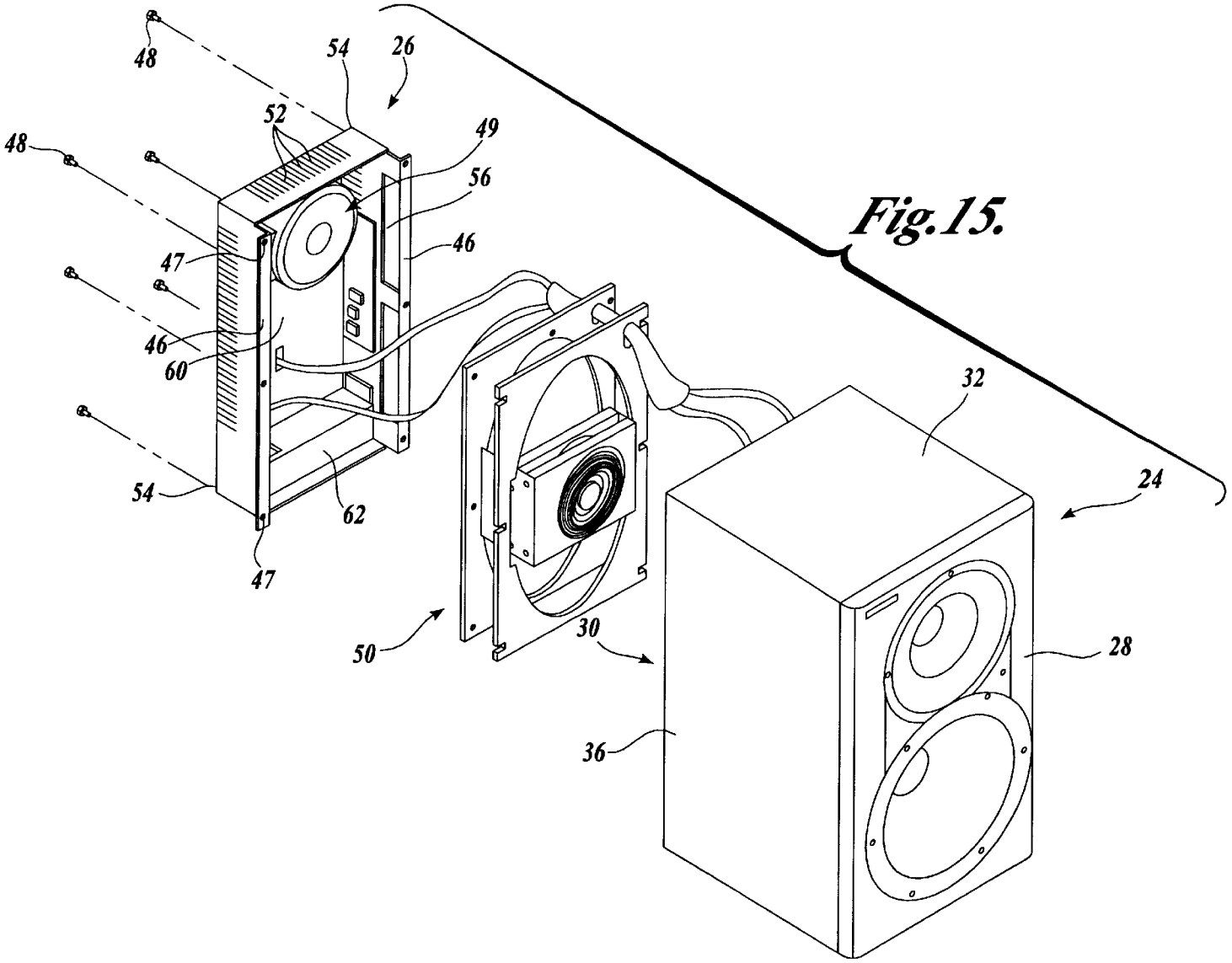
FIG. 15 is an exploded perspective view of the speaker enclosure, passive radiator, and electronics/heat sink housing.

Referring also to FIGS. 2, 3, 11 and 15, electronics housing/heat sink 26 is mounted on rear panel 30 of speaker enclosure 24. Housing 26 includes a planar back plate 38, a top plate 40, a bottom plate 42, and two side plates 44. Preferably, housing 26 includes a pair of flanges 46, one flange extending outwardly from a corresponding side plate 44 the front opening defined by the back plate 38, top plate 40, bottom plate 42, and two side plates 44. Flanges 46 are connected to rear panel 30 of speaker enclosure 24 by a plurality of fasteners 48 received into a corresponding plurality of mounting holes 47 of flanges 46 and speaker enclosure rear panel 30, as shown in FIG. 15. Housing 26 is mounted to overlie a passive radiator 50 (also shown in FIG. 15) and through which fasteners 48 extend, such that air flow caused by the movement of the passive radiator cools electronic components (collectively noted as "49" as shown in FIG. 14) that are mounted within the electronics/heat sink housing 26.

In a preferred embodiment of the invention, electronic heat sink housing 26 is fabricated of 1100 aluminum alloy sheet metal of a thickness of at least 0.125 inches. Alternatively, the electronics/heat sink housing may be fabricated of die-cast aluminum; but the thermal resistance is greater and the heat transfer efficiency of diecast metal is less than sheet metal due to the porosity of the die-cast material.

Electronics/heat sink housing 26 further includes a plurality of evenly spaced-apart slots 52, which are formed along a crease or corner portions 54 where side plates 44 and top plate 40 connect to back plate 38 of housing 26. Slots 52 are typically punched in the sheet metal that forms the housing before the sides and top are bent over in a press. Alternatively, the slots may be formed by die-casting. Additionally, larger slots 56 may be formed between each flange 46 and its corresponding side plate 44. In a preferred form, there are approximately nine to twenty-two smaller slots 52 between the back plate 38 and each corresponding side plate 44. There may be nine slots 52 between top plate 40 and back plate 38. There are preferably two larger slots 56 between each side flange 46 and its corresponding side plate 44.

Slots 52 and 56 serve at least two purposes. First, the surface area of the electronics/heat sink housing is increased by the additional surface area of the interior area around the edges of the slots. Second, the combined open area of the slots 52 and of larger slots 56 is greater than the surface area of passive radiator 50. Because the slots communicate between the face of the housing adjacent to the passive radiator and the exterior of the housing, and the total open area of the slots of the electronics/heat sink housing 26 is greater than the area of passive radiator 50, the acoustic pressure generated by the passive radiator is not restricted by the presence of the housing 26 that overlies the passive radiator 50. In a functional sense, passive radiator 50 is not adversely affected by the housing 26.

Figure 8:
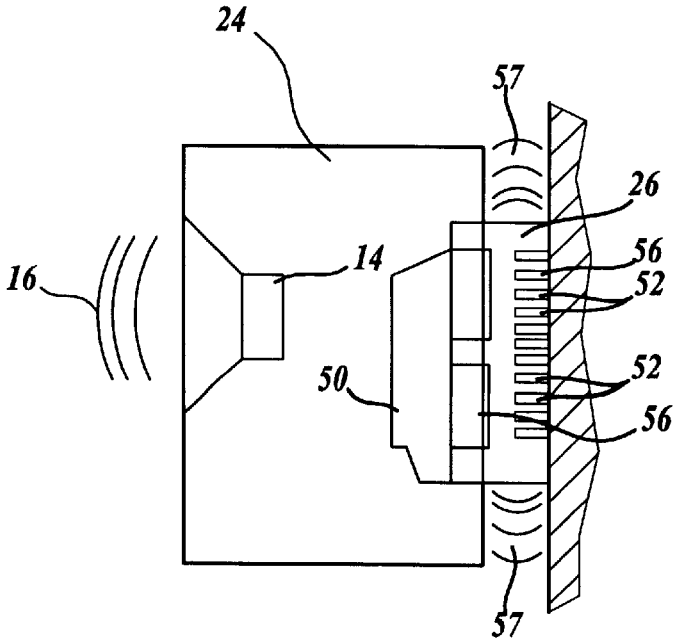
FIG. 8 is a schematic cross-sectional side view of the embodiment of the present invention placed against a wall and showing unblocked sound output.
Figure 9:
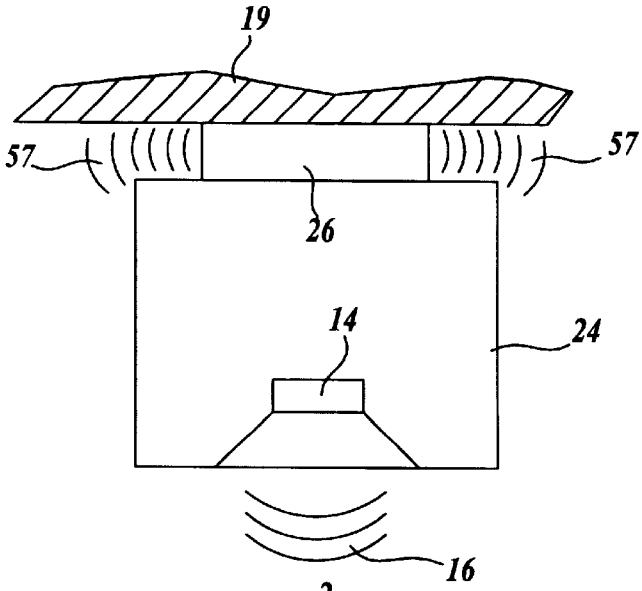
FIG. 9 is a schematic plan view of the embodiment shown in FIG. 8.
Figure 10:
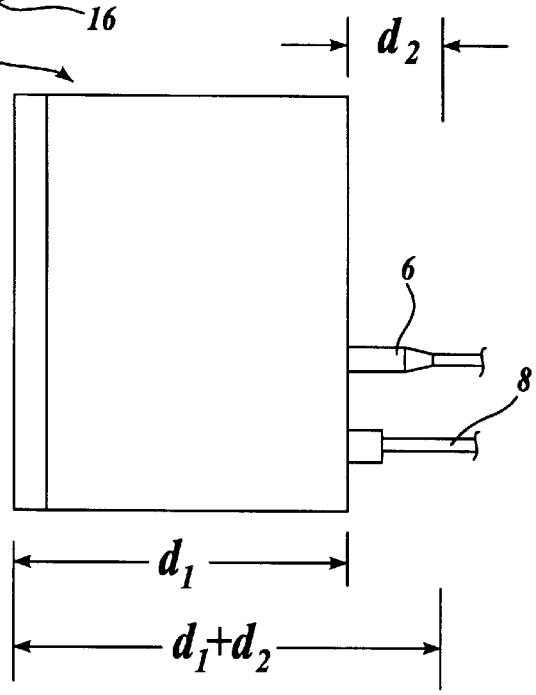
Fig.10. (PRIOR ART)
FIG. 10 (PRIOR ART) is a side elevational view of an enclosure with the input and power connectors coupled to a rear panel of the speaker enclosure and extending outwardly from same.

FIGS. 8 and 9 clearly illustrate how sound (pressure) waves 57 propagate from inside electronics/heat sink housing 26 when speaker enclosure 24 is pushed against wall 19 or other solid barrier. While a conventional rear mounted port or passive radiator would be adversely affected by the rear panel of the enclosure being pushed against a solid surface, the present invention is not so adversely affected because the combined open area of slots 52 and large slots 56 is greater than the area of passive radiator 50, and functions to transfer the heat from the speaker electronics. Sound pressure waves 57 are free to radiate from the slots on the side and top plates of the electronics/heat sink housing and exit in an unrestricted manner into the acoustic space surrounding the speaker enclosure 24.

While operating, passive radiator 50 will displace more than 34 cubic inches of air in one preferred embodiment. This displaced air passes through the plurality of slots 52 and 56 in the electronics/heat sink housing 26. The relatively high velocity air flow breaks up any stagnate boundary air layer around the housing and increases the convective efficiency of the heat sinks that are disposed within the housing and, which, at least in part, comprise the housing. For quiescent operating conditions, the plurality of slots facilitates the air flowing through the housing and the electronics, thereby cooling power transistors and a power transformer mounted therein. If a solid surface sheet without any slots were used for fabricating the electronics/heat sink housing, the air flow path from the passive radiator would be blocked and the thermal performance for the housing would be about equal to that of a solid flat plate of the same dimensions. Although a flat plate is a relatively efficient heat exchanger, it is not as effective for that purpose as a plate that has air flowing over its surface area. The effectiveness of a heat exchanger as a heat sink is dependent upon the total surface area of the device and the volume of air flowing over it. For electronics/heat sink housing 26, the thermal resistance is less than about 0.8° C./watt, which is comparatively good. Therefore, the electronics/heat sink housing of the present invention acts as an effective heat exchanger.

In a preferred embodiment, a pair of "L-shaped" brackets 58 (FIG. 3) or "L-shaped" bracket assembly 60 (FIG. 14) may be mounted within electronics/heat sink housing 26 to act as an additional heat sink. These brackets or bracket assembly are preferably fabricated from 0.187 inch thick 1100 aluminum alloy to provide optimal heat transfer from power transistors (not shown) that are mounted on the brackets or bracket assembly.

Figure 3:
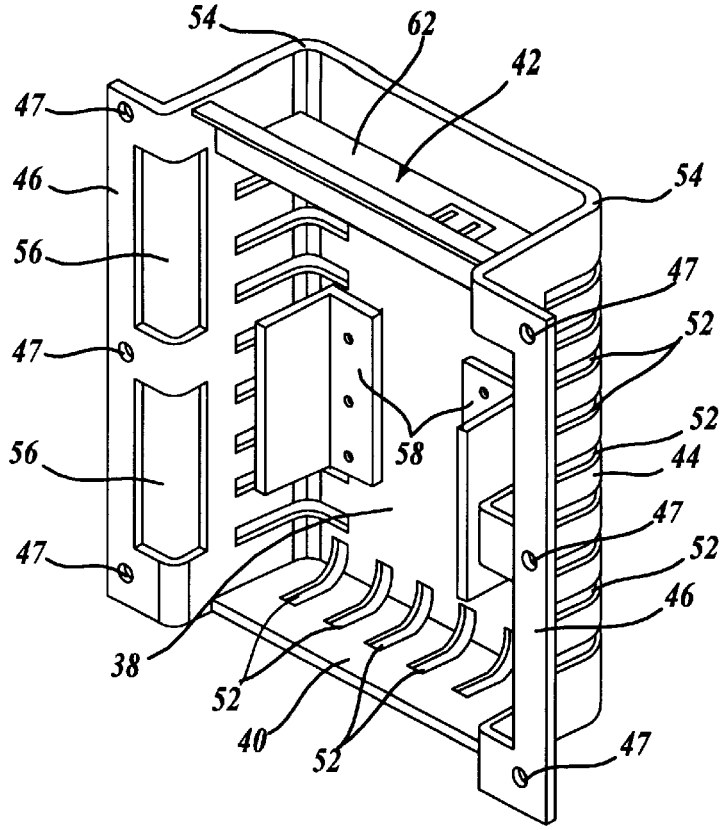
FIG. 3 is an isometric view of the interior of the housing and rotated 180° showing the internal heat sink brackets, and to better show a connector panel acting as a bottom plate of the housing defining openings of a size to receive incoming and power connector cables.
Figure 4:
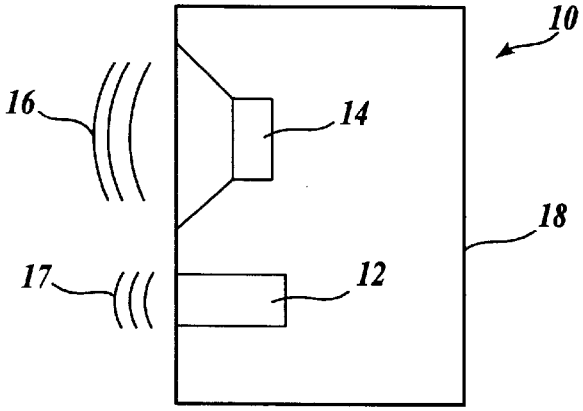
Fig.4. (PRIOR ART)
FIG. 4 (PRIOR ART) is a schematic cross-sectional side view of a ported enclosure having a vent or port disposed on the front of the enclosure.
Figure 5:
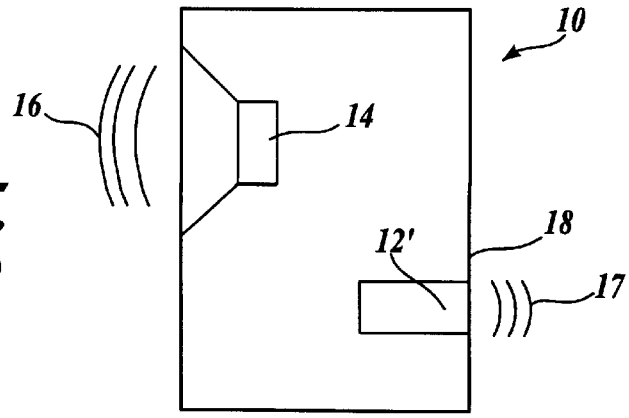
Fig.5. (PRIOR ART)
FIG. 5 (PRIOR ART) is a schematic cross-sectional side view of a ported enclosure having a vent or port disposed on the back of the enclosure.
Figure 6:
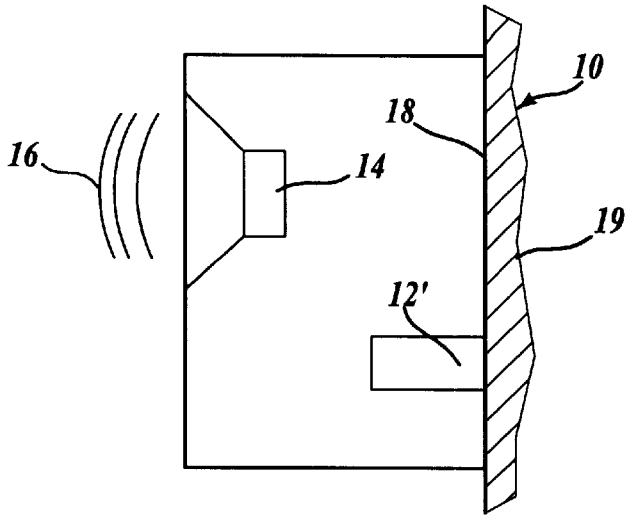
Fig. 6. (PRIOR ART)
FIG. 6 (PRIOR ART) is a schematic cross-sectional side view illustrating the ported enclosure of FIG. 5 positioned against a wall thereby blocking the vent and sound output.
Figure 7:
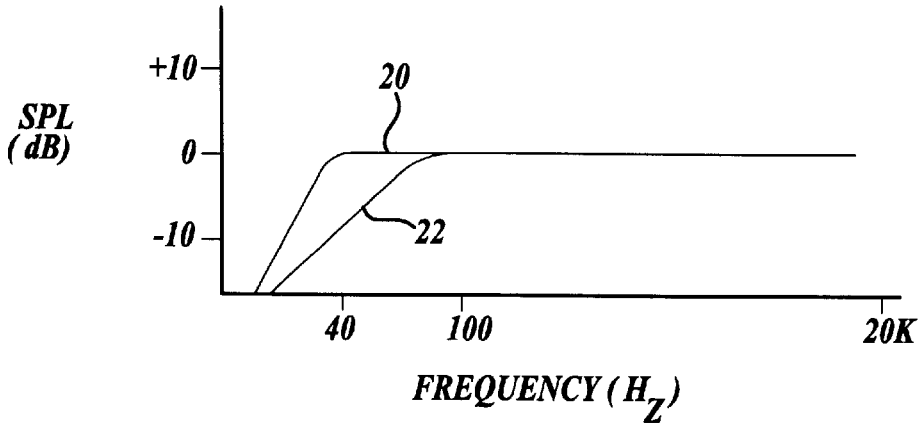
FIG. 7 is a graph of the frequency response of the ported enclosure in the states shown in FIG. 5 (unblocked vent) and FIG. 6 (blocked vent)

In another preferred embodiment, a sheet metal connector panel 62 functions as both bottom plate 42 of the electronics/heat sink housing 26 and a mounting surface for power and input connector cables 6, 8 as shown in FIGS. 3 and 14. This feature serves at least two purposes. First, it prevents undesired access through the bottom of the housing to the passive radiator; and, second, it provides a mounting surface for power and input connector cables 6, 8 without adding undesired depth to the overall speaker enclosure and electronics housing as the cables 6, 8 extend downwardly instead of outwardly on the speaker enclosure.

Figure 11:
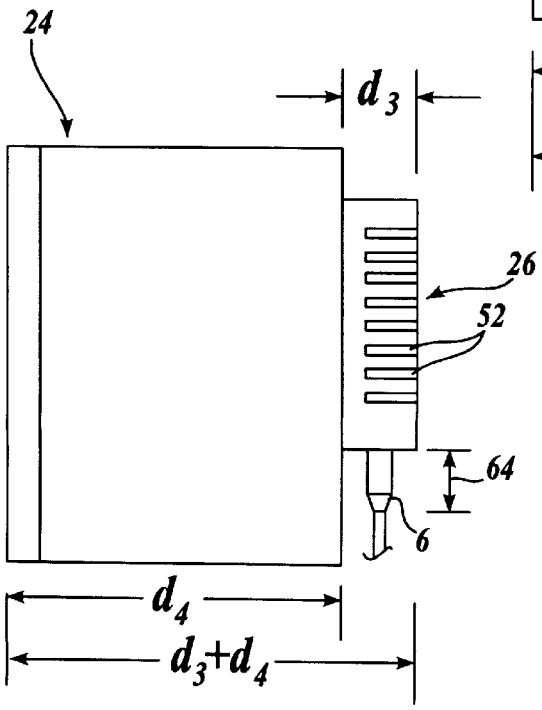
FIG. 11 is a side elevational view of the present invention, showing an input connector coupled to the control panel of FIG. 3 such that the input connector extends downwardly and does not add additional depth to the overall enclosure and electronics/heat sink housing combination.

Referring also to FIG. 11, the power and input connectors 6 and 8 can be mounted in a 90° style to minimize additional depth distance when the speaker enclosure with the electronics/heat sink housing 26 of the present invention is placed up against a wall or other surface. FIG. 11 illustrates how the power and input signal leads (connectors) are coupled into the bottom of the electronics/heat sink housing at connector panel 62. Thus, the overall distance with the connectors mounted to the connector panel 62 of the present invention maintains the shallow depth required such that the speaker enclosure can be placed on a twelve inch deep shelf with no overhang.

Also in preferred form, as best shown in FIGS. 1, 2, 8 and 11, housing 26 is mounted to rear panel 30 such that a vent relief space 64 is created along a length of rear panel 30 between bottom plate 42 (or connector panel 62) and the bottom panel 34 of the speaker enclosure 24. Vent relief space provides room for the mount and power connectors to extend when connected to connector panel 62.

The electronics/heat sink housing of the present invention is fairly easy to manufacture and is cost effective. It also provides appropriate heat transfer while still being able to be mounted dirty up against a wall. This feature allows the electronics/heat sink housing of the present invention, in combination with speaker enclosure 24, to fit on a standard twelve inch deep bookshelf. However, and most importantly, the sound quality is not blocked or minimized with the sound output venting toward the rear of the speaker, even if up against a wall or other surface.

The illustrated and described embodiments are represented by way of example. The scope of protection is not to be limited by these examples. Rather, protection is to be determined by the claims which follow, construed in accordance with established rules of patent claim construction, including use of doctrine of equivalents and reversal of parts.

What is claimed is:

1. An electronics/heat sink housing for a powered speaker having a speaker enclosure with a rear panel, a front panel, a pair of side panels, and a pair of end panels, a passive radiator mounted to the rear panel for propagating sound pressure waves and air movement, and electronic components to allow the speaker to audibly emit sound, said electronics/heat sink housing comprising:

a substantially planar back plate, a pair of oppositely-situated side plates and a top plate forming a cover of a size and shape to fit over the electronic components and passive radiator of the powered speaker, said cover being attached to the rear panel of the speaker enclosure over the electronic components and passive radiator; and said cover defining a plurality of slots communicating between an interior face thereof adjacent to the passive radiator and the exterior thereof and of a number such that the combined open area of the slots is greater than the surface area of the passive radiator in order to allow heat and air flow created by movement of the passive radiator to exit the slots outside the cover.

2. The electronics/heat sink housing according to claim 1, in which the cover further comprises a bottom plate, oppositely-positioned from the top plate, and connected to the back plate between the two side plates of the housing.

3. The electronics/heat sink housing according to claim 2, wherein the bottom plate further comprises a connector panel defining at least one opening of a size and shape to receive a connector cable such that the connector cable extends parallel of the enclosure in the longitudinal direction.

4. The electronics/heat sink housing according to claim 1, wherein the plurality of slots are positioned in corner portions between the side plates and the back plate.

5. The electronics/heat sink housing according to claim 1, wherein the slots are positioned in a corner portion between the top plate and the back plate.

6. The electronics/heat sink housing according to claim 1, wherein the slots are positioned in corner portions between both the top plate and the back plate, and the side plates and the back plate.

7. The electronics/heat sink housing according to claim 1, further comprising a pair of flanges that extend outwardly from the side plates, one flange per side plate, such that the flanges abut and fixedly attach to the rear panel of the speaker enclosure.

8. The electronics/heat sink housing according to claim 7, further comprising at least one slot between the flange and its corresponding side plate.

9. The electronics/heat sink housing according to claim 1, further comprising a heat sink bracket mounted within the cover.

10. The electronics/heat sink housing according to claim 9, wherein the heat sink bracket is a pair of "L-shaped" brackets.

11. The electronics/heat sink housing according to claim 9, wherein the heat sink bracket is an "L-shaped" bracket assembly having a pair of oppositely-situated "L-shaped" brackets interconnected by and integral with a rigid central member.

12. The electronics/heat sink housing according to claim 1, wherein the enclosure is at least 0.125 inches thick.

13. The electronics/heat sink housing according to claim 1, wherein the housing is fabricated from 1100 aluminum alloy sheet metal.

14. A powered speaker enclosure for a speaker having a passive radiator for propagating sound pressure waves and air movement and electronic components to allow the speaker to audibly emit the sound pressure waves, the speaker comprising:

a rear panel;

a front panel;

a pair of side panels; and a pair of end panels to form a structure having an interior of a size to contain a passive radiator;

an electronics/heat sink housing including a planar back plate, a pair of oppositely-situated side plates, and a top plate, such that the side plates, top plate and back plate form a cover of a size and shape to fit over the electronic components and passive radiator of the powered speaker;

said housing being attached to the rear panel of the speaker enclosure over the electronic components and the passive radiator; and said housing defining a plurality of slots communicating between the interior and exterior of the speaker enclosure and of a number such that the combined open area of the slots is greater than the surface area of the passive radiator in order to allow heat and air flow created by movement of the passive radiator to exit the slots outside the housing.

15. The powered speaker enclosure according to claim 14, in which the housing further comprises a bottom plate, oppositely-positioned from the top plate, and connected to the back plate between the two side plates of the housing.

16. The powered speaker enclosure according to claim 15, wherein the bottom plate further compresses a connector panel defining at least one opening of a size and shape to receive a connector cable such that the connector cable extends parallel of the enclosure in the longitudinal direction.

17. The powered speaker enclosure according to claim 15, wherein the housing is fabricated from 1100 aluminum alloy sheet metal.

18. The powered speaker enclosure according to claim 14, wherein the plurality of slots are positioned in corner portions between the side plates and the back plate.

19. The powered speaker enclosure according to claim 14, wherein the slots are positioned in a corner portion between the top plate and the back plate.

20. The powered speaker enclosure according to claim 14, wherein the slots are positioned in corner portions between both the top plate and the back plate, and the side plates and the back plate.

21. An electronic/heat sink housing for a powered speaker having a speaker enclosure with a rear panel, a front panel, a pair of side panels, and a pair of end panels, a passive radiator mounted to the rear panel for propagating sound pressure waves and air movement, and electronic components to allow the speaker to audibly emit sound, said electronics/heat sink housing comprising:

a substantially planar back plate, a pair of oppositely-situated side plates and a top plate forming a cover of a size and shape to fit over the electronic components and passive radiator of the powered speaker, said cover being attached to the rear panel of the speaker enclosure over the electronic components and passive radiator; and said cover defining a plurality of slots of a number such that the combined open area of the slots is greater than the surface area of the passive radiator in order to allow heat and air flow created by movement of the passive radiator to exit the slots outside the cover, the cover further comprising a pair of flanges that extend outwardly from the side plates, one flange per side plate, such that the flanges abut and fixedly attach to the rear panel of the speaker enclosure.

22. The electronics/heat sink housing according to claim 21, further comprising at least one slot between the flange and its corresponding side plate.

* * * * *